US012000131B2

(12) United States Patent
Tsubone et al.

(10) Patent No.: US 12,000,131 B2
(45) Date of Patent: Jun. 4, 2024

(54) FLUSH TOILET

(71) Applicant: TOTO LTD., Kitakyushu (JP)

(72) Inventors: Yuichi Tsubone, Fukuoka (JP); Chisato Sone, Fukuoka (JP); Hiroshi Hashimoto, Fukuoka (JP); Yuya Miyake, Fukuoka (JP); Shigeru Okada, Fukuoka (JP); Kenichi Takano, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 66 days.

(21) Appl. No.: 17/884,769

(22) Filed: Aug. 10, 2022

(65) Prior Publication Data

US 2023/0137859 A1 May 4, 2023

(30) Foreign Application Priority Data

Oct. 29, 2021 (JP) ..... 2021-178358

(51) Int. Cl.
*E03D 11/16* (2006.01)
*E03D 11/18* (2006.01)

(52) U.S. Cl.
CPC ..... *E03D 11/16* (2013.01); *E03D 11/18* (2013.01)

(58) Field of Classification Search
CPC ..... E03D 11/16
See application file for complete search history.

(56) References Cited

U.S. PATENT DOCUMENTS 5,819,326 A * 10/1998 Kobayashi ..... E03D 11/16 285/58
6,108,826 A * 8/2000 Hayashi ..... H04N 21/434 348/E5.005
8,011,029 B2 * 9/2011 Kamiya ..... E03D 11/16 4/252.1
2016/0273207 A1 * 9/2016 Saito ..... E03D 11/16

FOREIGN PATENT DOCUMENTS

JP 2010236203 A * 10/2010

* cited by examiner

*Primary Examiner* — Christine J Skubinna
(74) *Attorney, Agent, or Firm* — Amin, Turocy & Watson, LLP

(57) ABSTRACT

A flush toilet includes a bowl part, a drainage water trap part that is connected to a bottom part thereof, and a water drainage socket that is connected thereto and includes a back side R part that changes a flow channel so that washing water flowing from an upper side is directed to a front side, a front side R part that is provided on a downstream side of the back side R part and changes a flow channel so that washing water flowing from a back side is directed to a lower side, a water storage part that stores a part of washing water on a flow channel from the back side R part to the front side R part, and a throttle part that is provided on a downstream side of the front side R part and decreases a cross-sectional area of a flow channel thereof.

5 Claims, 11 Drawing Sheets

FLUSH TOILET

CROSS-REFERENCE TO RELATED APPLICATION(S)

The present application is based upon and claims the benefit of priority to Japanese Patent Application No. 2021-178358, filed on Oct. 29, 2021, the entire contents of which are herein incorporated by reference.

FIELD

A disclosed embodiment(s) relate(s) to a flush toilet.

BACKGROUND

A flush toilet conventionally includes a water drainage socket that connects a drainage water trap part that discharges waste in a bowl part and a water drainage port of a floor surface. Furthermore, a plurality of kinds of water drainage sockets that are dependent on a shape of a piping are provided where, for example, a so-called backward-curved water drainage socket that is provided with an upstream side that is connected to a drainage water trap part and a downstream side that is once curved (extends) toward a back side of a toilet and subsequently extends toward a front side of such a toilet so as to be connected to a water drainage port and/or the like has/have been known (see, for example, U.S. Pat. No. 8,011,029).

Meanwhile, in a flush toilet as described above, at a time of toilet washing, for example, a water drainage socket is filled with washing water so as to cause a siphon action and thereby discharge waste. However, in a flush toilet according to a conventional technique, a siphon action is not readily sustained to a downstream side of a water drainage socket depending on, for example, a length of a water drainage flow channel of such a water drainage socket and/or the like, and as a result, a discharge performance may be degraded. Thus, a conventional technique has room for improvement in that a discharge performance for waste is improved.

SUMMARY

A flush toilet according to an aspect of an embodiment includes a bowl part that includes a waste-receiving surface with a bowl shape and a rim part that is formed on an upper side of the waste-receiving surface, a water spout part that is provided on the rim part and spouts washing water toward an inside of the bowl part, a drainage water trap part that is connected to a bottom part of the bowl part and discharges waste in the bowl part, and a water drainage socket that is provided with an upstream side that is connected to the drainage water trap part and a downstream side that is connected to a water drainage port of a floor surface where the water drainage socket includes a back side R part that changes a flow channel in such a manner that washing water that flows from an upper side is directed to a front side, a front side R part that is provided on a downstream side of the back side R part and changes a flow channel in such a manner that washing water that flows from a back side is directed to a lower side, and a water storage part that stores a part of washing water on a flow channel from the back side R part to the front side R part, wherein the water drainage socket includes a throttle part that is provided on a downstream side of the front side R part and decreases a cross-sectional area of a flow channel of the front side R part.

BRIEF DESCRIPTION OF DRAWING(S)

DESCRIPTION OF EMBODIMENT(S)

Hereinafter, an embodiment(s) of a flush toilet as disclosed in the present application will be explained in detail, with reference to the accompanying drawing(s). Additionally, this invention is not limited by an embodiment(s) as illustrated below.

Embodiment

Overall Configuration of Flush Toilet

Figure 1:
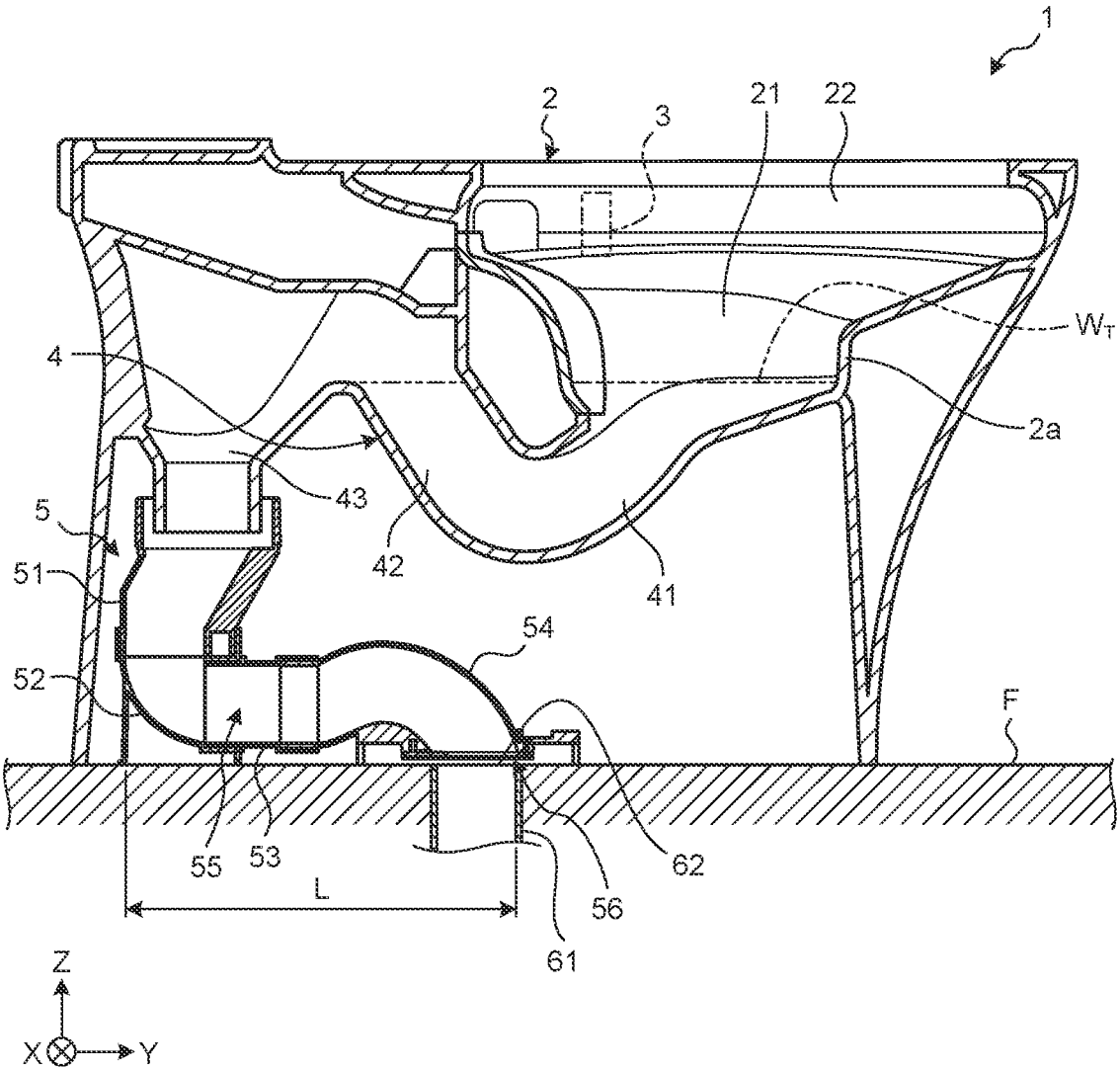
FIG. 1 is a side cross-sectional view that illustrates a flush toilet according to an embodiment.

First, an overall configuration of a flush toilet 1 according to an embodiment will be explained with reference to FIG. 1. FIG. 1 is a side cross-sectional view that illustrates a flush toilet 1 according to an embodiment. Additionally, FIG. 1 illustrates a three-dimensional orthogonal coordinate system that includes a Z-axis where a vertically upward direction is provided as a positive direction thereof, for providing a clear explanation. Such an orthogonal coordinate system may also be illustrated in another/other figure(s).

Furthermore, in a following explanation, a positive direction of an X-axis, a negative direction of such an X-axis, a positive direction of a Y-axis, a negative direction of such a Y-axis, a positive direction of a Z-axis, and a negative direction of such a Z-axis in an orthogonal coordinate system may be described as a "right side", a "left side", a "front side", a "back side", a "upper side", and a "lower side", respectively. Additionally, any of FIG. 1, FIG. 2, and a subsequently illustrated figure(s) is a schematic diagram.

As illustrated in FIG. 1, the flush toilet 1 includes a bowl part 2, a water spout part 3, a drainage water trap part 4, and a water drainage socket 5. Furthermore, the flush toilet 1 is a floor-mounted flush toilet. Additionally, although a toilet body that includes the bowl part 2 and/or the like is made of, for example, a ceramic, this is not limiting and it may be made of, for example, a resin or may be manufactured by combing a ceramic and a resin.

The bowl part 2 includes a waste-receiving surface 21 and a rim part 22. The waste-receiving surface 21 is formed into a bowl shape that is capable of receiving waste. The rim part 22 is formed on an upper side of the waste-receiving surface 21 and is formed so as to compose an upper edge of the bowl part 2. Additionally, FIG. 1 omits illustration of some members such as a toilet seat that is provided on an upper part of the bowl part 2 and/or a cover that covers such a toilet seat, for simplification of illustration.

The water spout part 3 spouts a washing water toward an inside of the bowl part 2. For example, the water spout part 3 is provided on the rim part 22 and spouts washing water that is supplied from a non-illustrated water storage tank into the bowl part 2 through a water spout port. Additionally, FIG. 1 schematically illustrates the water spout part 3 (a water spout port) by a long dashed double-dotted line, for simplification of illustration.

Washing water that is spouted from the water spout part 3 generates a swirling flow on, for example, the waste-receiving surface 21 of the bowl part 2 so as to execute washing of the bowl part 2. Furthermore, washing water that is supplied to the bowl part 2 is stored in the bowl part 2 and the drainage water trap part 4 after toilet washing. Additionally, FIG. 1 illustrates washing water that is stored in the bowl part 2 and the drainage water trap part 4 by a long dashed double-dotted line where such washing water may be described as storage water $W_T$ below. Thus, the drainage water trap part 4 and/or the like is/are filled with storage water $W_T$, so that such storage water $W_T$ functions as a seal water so as to prevent an odor and/or the like from a water drainage piping 61 as described later from flowing backward to a side of the bowl part 2.

As a configuration of the drainage water trap part 4 is explained, the drainage water trap part 4 is connected to a bottom part 2*e* of the bowl part 2 and discharges waste in the bowl part 2 together with washing water. In detail, the drainage water trap part 4 includes an inlet part 41, an ascending pipeline 42, and a descending pipeline 43.

The inlet part 41 is connected to a lower side of the waste-receiving surface 21 of the bowl part 2 so as to be continuous therewith and causes washing water and/or waste from the bowl part 2 to flow into the drainage water trap part 4. The ascending pipeline 42 is connected to the inlet part 41 and is formed so as to extend obliquely backward and upward from a downstream end part of the inlet part 41. The descending pipeline 43 is connected to the ascending pipeline 42 and is formed so as to extend downward from a downstream end part of the ascending pipeline 42. Furthermore, a downstream end part of the descending pipeline 43 is connected to the water drainage socket 5.

Therefore, in a case where toilet washing is executed, in the drainage water trap part 4, washing water and/or waste in the bowl part 2 is/are discharged to the water drainage socket 5, through the inlet part 41, the ascending pipeline 42, and the descending pipeline 43.

Configuration of Water Drainage Socket

Next, the water drainage socket 5 will be explained. The water drainage socket 5 discharges washing water and/or waste from the drainage water trap part 4 to the water drainage piping 61. For example, the water drainage socket 5 is provided with an upstream side that is connected to the drainage water trap part 4 (accurately, the descending pipeline 43 of the drainage water trap part 4) and a downstream side that is connected to a water drainage port 62 of a floor surface F, and hence, discharges washing water and/or the like from the drainage water trap part 4 to the water drainage piping 61.

Furthermore, the water drainage socket 5 is a so-called backward-curved water drainage socket that is provided with an upstream side that is connected to the drainage water trap part 4 and a downstream side that is once curved to a back side of a toilet (a negative direction of a Y-axis) and subsequently extends toward a front side of such a toilet (a positive direction of a Y-axis) so as to be connected to the water drainage port 62, as described above.

Meanwhile, in the flush toilet 1 as described above, at a time of toilet washing, for example, the water drainage socket 5 is filled with washing water so as to cause a siphon action and thereby discharge waste. However, in a case where the water drainage socket 5 is, for example, a backward-curved water drainage socket, a length of a water drainage flow channel of the water drainage socket 5 (for example, a length L of a water drainage flow channel as illustrated in FIG. 1 in frontward and backward directions (directions of a Y-axis) and/or the like) is comparatively readily increased. Hence, in the flush toilet 1, a break of a siphon action is caused before reaching a downstream side of the water drainage socket 5, in other words, such a siphon action is not readily sustained to such a downstream side of the water drainage socket 5, and as a result, a discharge performance thereof may be degraded. Additionally, an event where a siphon action is not readily sustained to a downstream side of the water drainage socket 5 as described above could occur in not only a backward-curved water drainage socket.

Figure 2:
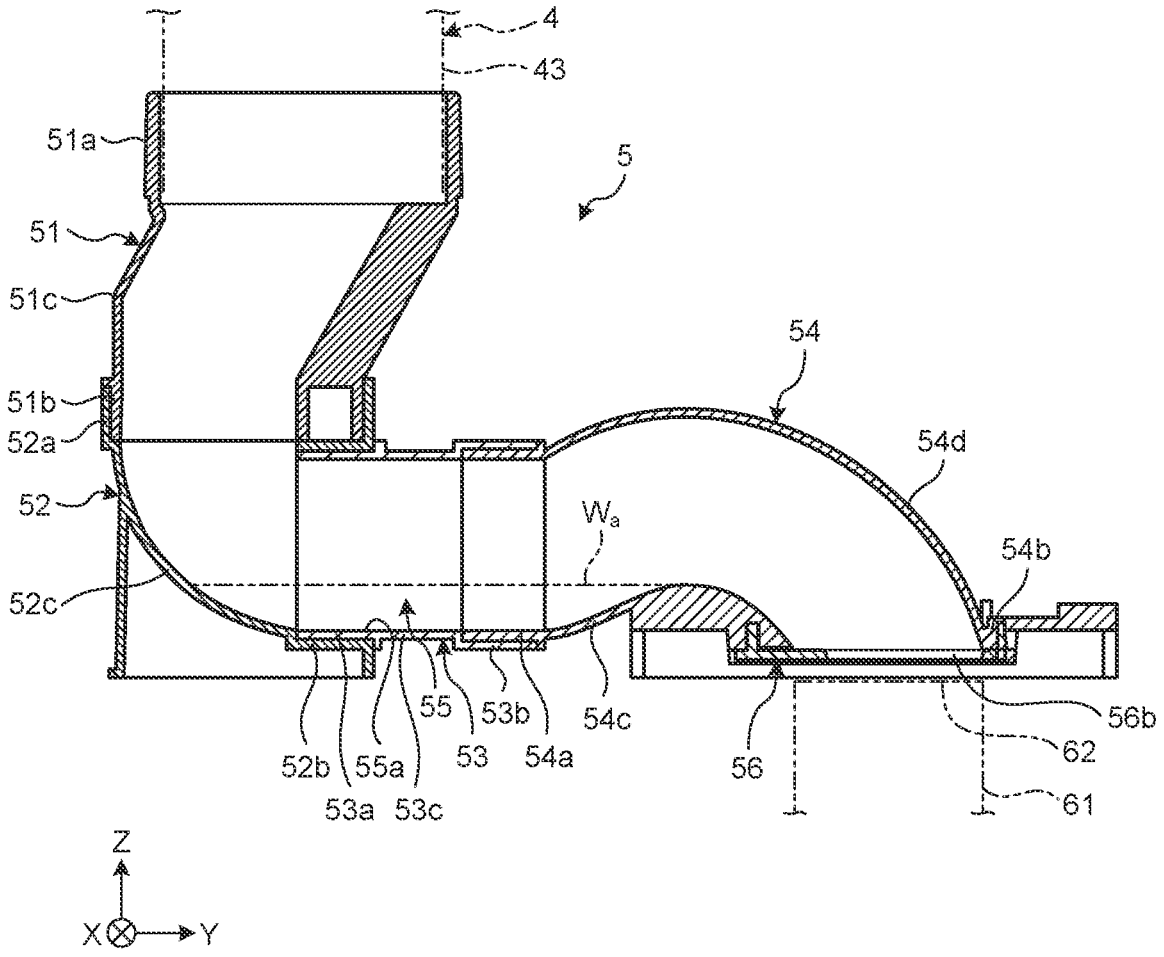
FIG. 2 is an enlarged cross-sectional view of a water drainage socket.

Hence, the present embodiment is configured in such a manner that it is possible to improve a discharge performance for waste. Hereinafter, such a configuration will specifically be explained with further reference to FIG. 2. FIG. 2 is an enlarged cross-sectional view of a water drainage socket 5.

As illustrated in FIG. 1 and FIG. 2, the water drainage socket 5 includes a longitudinal pipe 51, a back side R part 52, a horizontal pipe 53, a front side R part 54, a water storage part 55, and a throttle part 56. Additionally, although the water drainage socket 5 is made of a resin, this is not limiting.

The longitudinal pipe 51 is a piping that extends in a vertical direction (a direction of a Z-axis) and causes washing water that flows from an upper side to flow downward. For example, the longitudinal pipe 51 is provided with an upstream side end part 51*a* that is connected to the drainage water trap part 4 (accurately, the descending pipeline 43 of the drainage water trap part 4) and a downstream side end part 51*b* that is connected to the back side R part 52, as illustrated in FIG. 2.

An intermediate part 51*c* is formed between the upstream side end part 51*a* and the downstream side end part 51*b*. Such an intermediate part 51*c* is formed so as to be curved to a back side (a negative direction of a Y-axis), and thereby, a flow channel for the longitudinal pipe 51 is curved backward. Thereby, in the water drainage socket 5, washing water readily fills a vicinity of a curved part of the longitudinal pipe 51, and hence, it is possible to readily cause a siphon action.

The back side R part 52 is a piping that is arranged on a back side of the flush toilet 1 and changes a flow channel in such a manner that washing water that flows from an upper side is directed to a front side. For example, the back side R part 52 is provided with an upstream side end part 52*a* that is connected to the longitudinal pipe 51 (accurately, the downstream side end part 51*b* of the longitudinal pipe 51) and a downstream side end part 52*b* that is connected to the horizontal pipe 53.

A curved part 52*c* is formed between the upstream side end part 52*a* and the downstream side end part 52*b*. Such a curved part 52*c* is formed so as to be curved frontward and thereby change a flow channel for washing water that flows from an upper side to a flow channel that is directed to a front side.

The horizontal pipe 53 is a piping that extends in frontward and backward directions (directions of a Y-axis) and causes washing water that flows from a back side to flow forward. For example, the horizontal pipe 53 is provided with an upper side end part 53*a* that is connected to the back side R part 52 (accurately, the downstream side end part 52*b* of the back side R part 52) and a downstream side end part 53*b* that is connected to the front side R part 54.

An intermediate part 53*c* is formed between the upstream side end part 53*a* and the downstream side end part 53*b*. Such an intermediate part 53*c* is formed so as to extend in frontward and backward directions, and hence, causes washing water that flows from a back side to flow forward.

The front side R part 54 is a piping that is provided on a front side of the flush toilet 1 (a positive direction of a Y-axis), in other words, a downstream side of the back side R part 52 and changes a flow channel in such a manner that washing water that flows from a back side is directed to a lower side. For example, the front side R part 54 is provided with an upstream side end part 54*a* that is connected to the horizontal pipe 53 (accurately, the downstream side end part 53*b* of the horizontal pipe 53) and a downstream side end part 54*b* that is connected to the water drainage port 62 of the water drainage piping 61 through the throttle part 56.

An ascending part 54*c* and a descending part 54*d* are formed between the upstream side end part 54*a* and the downstream side end part 54*b*. The ascending part 54*c* is connected to the upstream side end part 54*a* and is formed so as to extend obliquely forward and upward from the upstream side end part 54*a*. The descending part 54*d* is connected to the ascending part 54*c* and is formed so as to extend downward from a downstream side of the ascending part 54*c*. Thus, the front side R part 54 is formed in such a manner that the ascending part 54*c* and the descending part 54*d* are curved, and thereby, changes a flow channel for a washing water that flows from a back side to a flow channel that is directed to a lower side.

Furthermore, the water drainage socket 5 includes the ascending part 54*c* that is formed in such a manner that the front side R part 54 extends obliquely frontward and upward, so that the water storage part 55 that stores a part of washing water is formed on a flow channel from the back side R part 52 to the front side R part 54. Additionally, FIG. 2 illustrates washing water that is stored in the water storage part 55 by a long dashed double-dotted line where such washing water may be described as storage water $W_a$ below.

Thus, the water drainage socket 5 includes the water storage part 55 where storage water $W_a$ is stored constantly, so that, for example, at a time of toilet washing, such storage water $W_a$ is utilized so as to fill an inside of a piping with a comparatively low amount of washing water, and hence, it is possible to cause a siphon action promptly.

Figure 3:
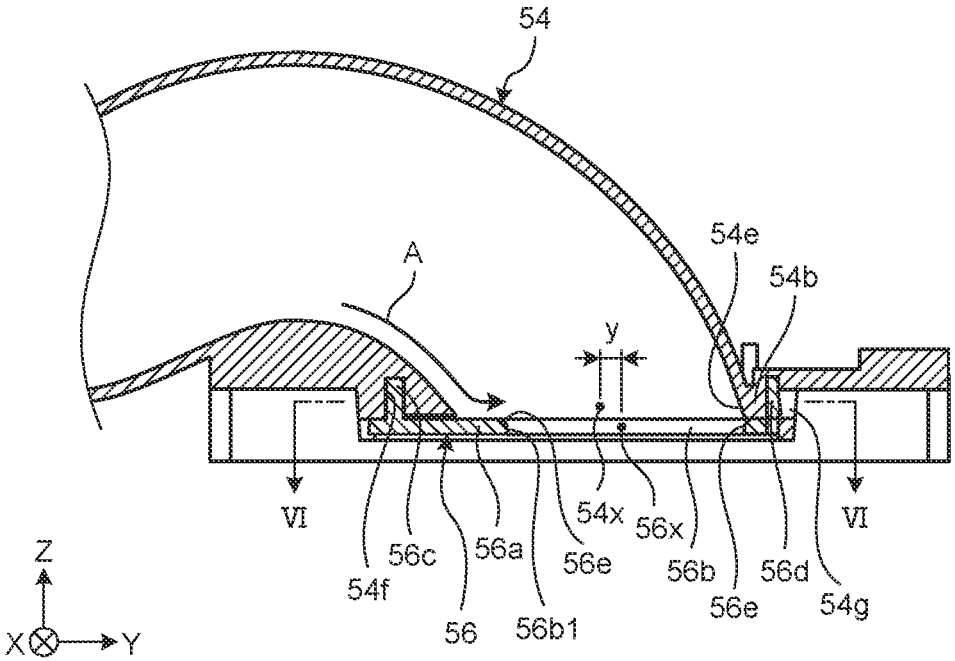
FIG. 3 is an enlarged cross-sectional view of a vicinity of a throttle part.
Figure 4:
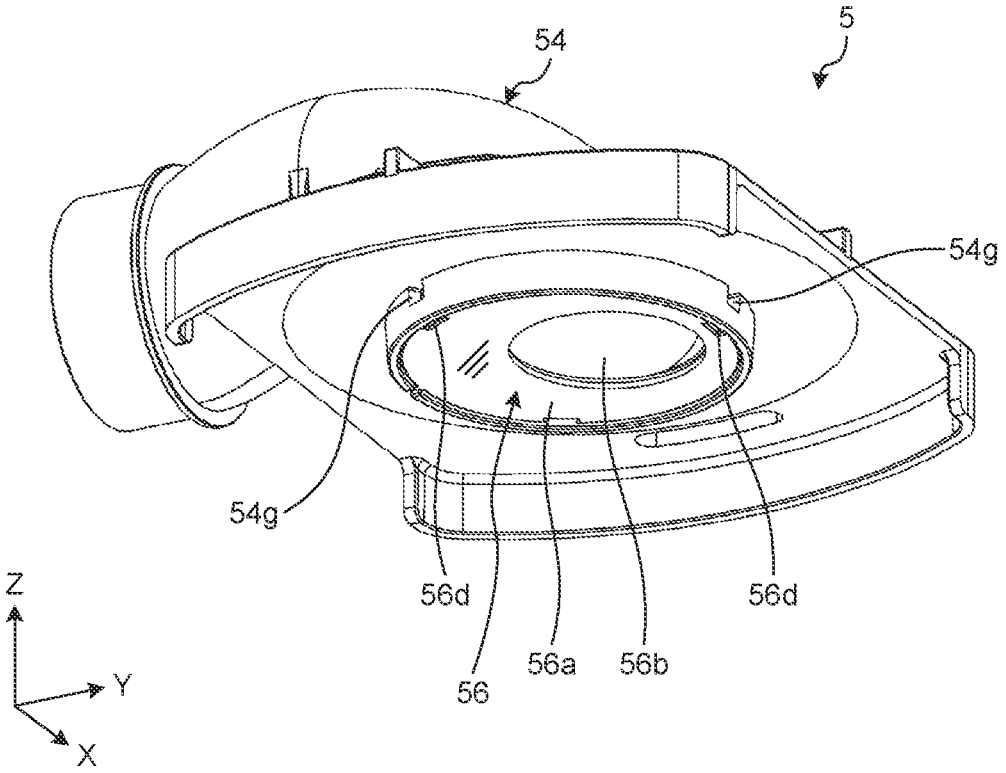
FIG. 4 is a perspective view when a throttle part and a front side R part are viewed from a lower side.
Figure 5:
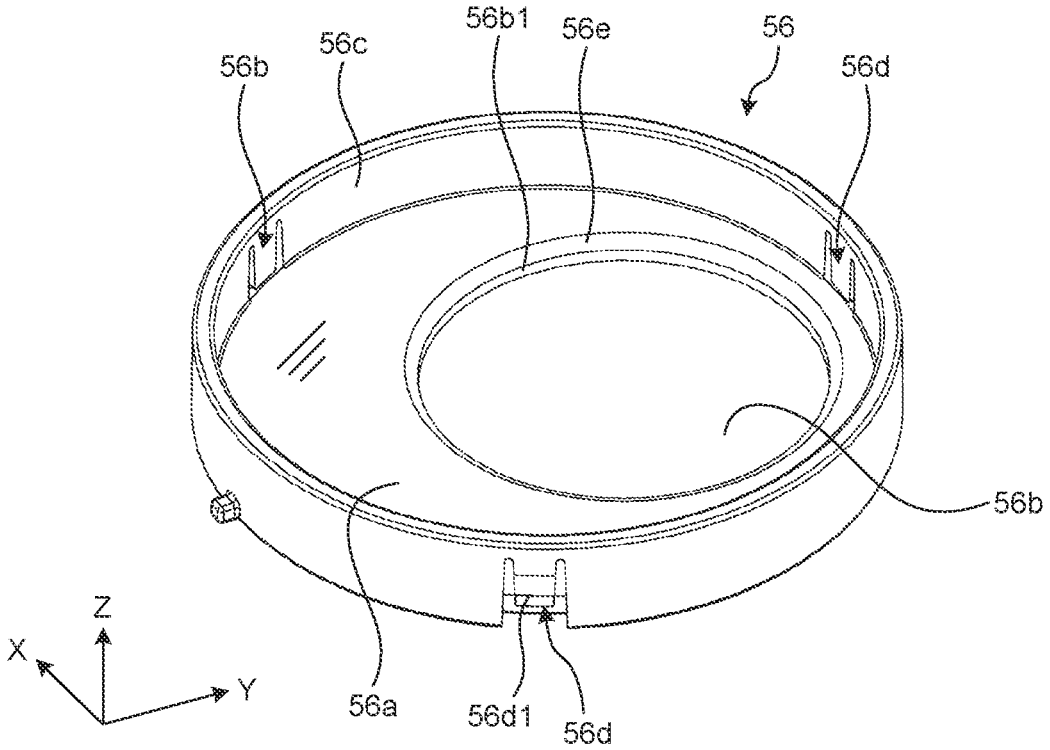
FIG. 5 is a perspective view of a throttle part.
Figure 6:
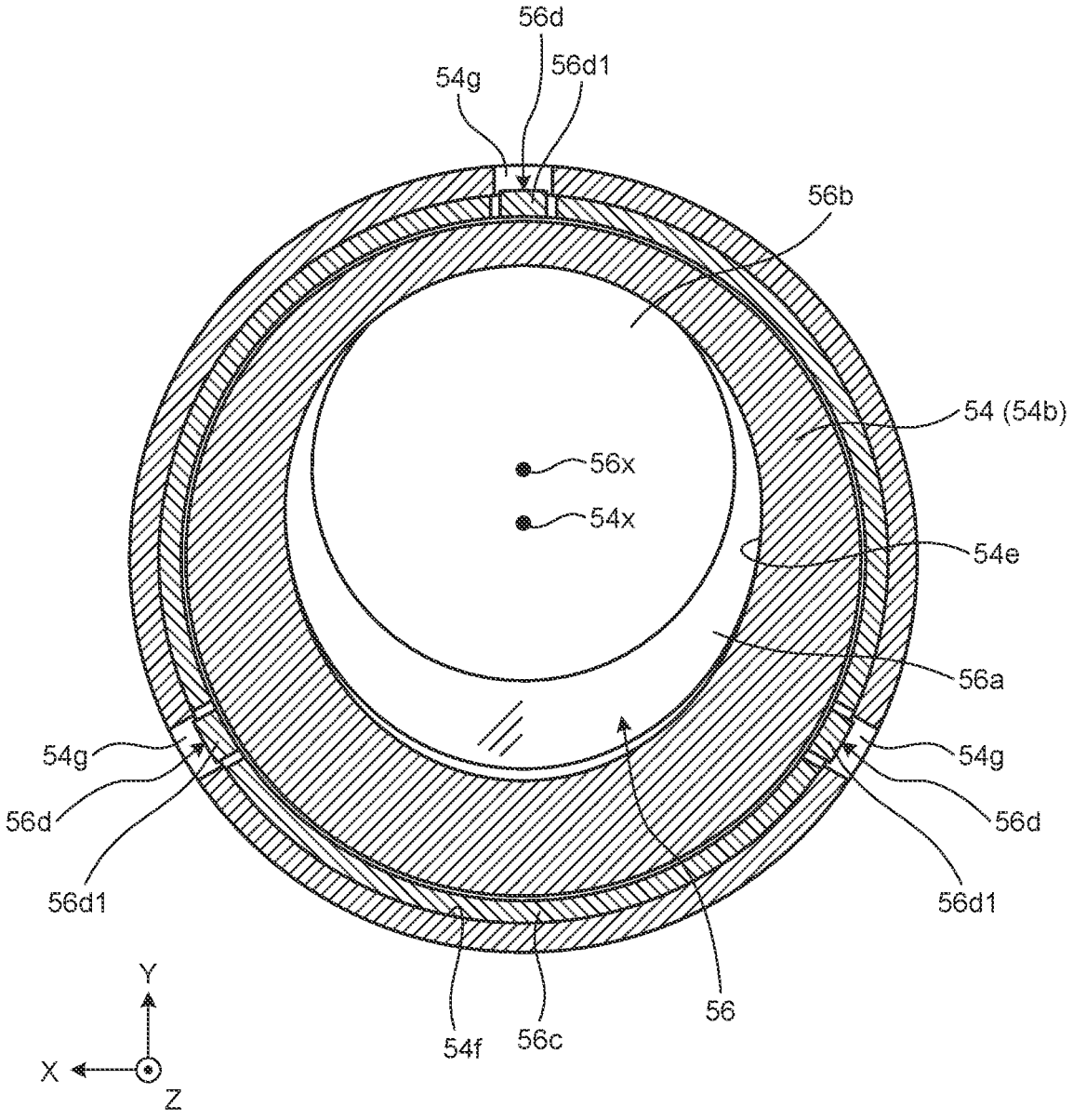
FIG. 6 is a cross-sectional view along a line VI-VI in FIG. 3.

Next, the throttle part 56 will be explained with reference to FIG. 3 to FIG. 6. FIG. 3 is an enlarged cross-sectional view of a vicinity of a throttle part 56. FIG. 4 is a perspective view when the throttle part 56 and a front side R part 54 are viewed from a lower side. FIG. 5 is a perspective view of a throttle part 56 and FIG. 6 is a cross-sectional view along a line VI-VI in FIG. 3.

As illustrated in FIG. 3 and/or the like, the throttle part 56 is a member that is provided on a downstream side of the front side R part 54 and decreases a cross-sectional area of a flow channel of the front side R part 54. A water drainage socket 5 according to the present embodiment includes the throttle part 56, so that it is possible to improve a discharge performance of a flush toilet 1.

As a specific explanation is provided, the throttle part 56 includes a bottom surface part 56*a*, an opening part 56*b*, a side wall part 56*c* (that is not illustrated in FIG. 4), and an engagement part 56*d*, as illustrated in FIG. 3 to FIG. 6.

The bottom surface part 56*a* is formed into a plate shape, in other words, is formed into a disk shape. The opening part 56*b* is formed on the bottom surface part 56*a* and forms a flow channel for the throttle part 56. For example, the opening part 56*b* is formed into a circular shape. Additionally, a shape of the opening part 56*b* is not limited to a circular shape and may be another kind of shape such as, for example, an elliptical shape.

Furthermore, as illustrated in FIGS. 3 and 6 and/or the like, an opening area of the opening part 56*b* of the throttle part 56 is set so as to be less than an opening area of an opening part 54*e* (accurately, an opening part 54*e* of a downstream side end part 54*b*) of the front side R part 54. Herein, an opening area of the opening part 56*b* of the throttle part 56 corresponds to a flow channel cross-sectional area of a flow channel for the throttle part 56 and an opening area of the opening part 54*e* of the front side R part 54 corresponds to a flow channel cross-sectional area of a flow channel for the front side R part 54.

Therefore, the throttle part 56 that has the bottom surface part 56*a* and the opening part 56*b* as described above is provided on a downstream side of the front side R part 54, so that a flow channel cross-sectional area of the front side R part 54 is decreased. In other words, the throttle part 56 is provided so as to cover the opening part 54*e* of the front side R part 54 partially, that is, is provided so as to narrow a part of a flow channel of the front side R part 54.

Thereby, for example, at a time of toilet washing, washing water that flows through the front side R part 54 strikes the bottom surface part 56*a* so as to change a flow direction thereof, as illustrated by an arrow A in FIG. 3, and as a result, a vicinity of the front side R part 54 and the throttle part 56 is readily filled with washing water. Hence, for example, storage water $W_a$ is utilized for a water storage part 55, so that it is possible to cause a siphon action that is caused at the water storage part 55 and on an upstream side of the water storage part 55, in the water drainage socket 5 sustainably, without causing a break thereof to a downstream side of the water drainage socket 5, that is, the throttle part 56. In the present embodiment, such a siphon action is caused, so that it is possible to discharge waste, together with washing water, from a water drainage port 62 (see FIG. 2) reliably, and hence, it is possible to improve a discharge performance for waste in the flush toilet 1.

Furthermore, the throttle part 56 is formed in such a manner that a cross-sectional area of a flow channel in the opening part 56*b* is minimum in a whole flow channel for the front side R part 54. Thereby, for example, at a time of toilet washing, it is possible to change a flow direction of washing water that flows through the front side R part 54 reliably, and as a result, a vicinity of the front side R part 54 and the throttle part 56 is filled with washing water more readily. Hence, it is possible to cause a siphon action in the water drainage socket 5 sustainably, without causing a break thereof to the throttle part 56 of the water drainage socket 5, and hence, it is possible to further improve a discharge performance for waste in the flush toilet 1. Additionally, although a cross-sectional area of a flow channel of the throttle part 56 is minimum in a whole flow channel of the front side R part 54 in the above, this is not limiting.

Furthermore, the throttle part 56 is provided at a position that is lower than that of a lower end part 55*a* of the water storage part 55 (see FIG. 2). In detail, the throttle part 56 is provided on the front side R part 54 in such a manner that the opening part 56*b* that forms a flow channel is provided at a position that is lower than that of the lower end part 55*a* of the water storage part 55. In other words, the throttle part 56 is provided between the opening part 56*b* and the lower end part 55*a* of the water storage part 55 so as to cause a water level difference in such a manner that a position of the opening part 56*b* is lower than a position of the lower end part 55*a*.

Thereby, it is possible to increase, for example, a flow velocity (in other words, a water strength) of washing water that flows from the water storage part 55 to the throttle part 56 through the front side R part 54 at a time when falling onto the throttle part 56. Then, a flow direction of washing water with an increased flow velocity is changed by the throttle part 56, so that a vicinity of the front side R part 54 and the throttle part 56 is filled with washing water more readily, and hence, it is possible to cause a siphon action reliably.

Furthermore, the throttle part 56 is formed so as to plug a back side of the opening part 54*e* of the front side R part 54 as illustrated in FIGS. 3 and 6. In detail, the throttle part 56 is formed so as to open a front side (a positive direction of a Y-axis) of the opening part 54*e* of the front side R part 54 by the opening part 56*b* and plug a back side (a negative direction of such a Y-axis) of the opening part 54*e* of the front side R part 54 by the bottom surface part 56*a*.

In more detail, a center 56*x* of a flow channel of the throttle part 56 in a radial direction thereof is located on a front side of a center 54*x* of a flow channel of a site where the throttle part 56 is provided in the front side R part 54 (that is, the downstream side end part 54*b*) in a radial direction thereof. In other words, a center 56*x* of the opening part 56*b* of the throttle part 56 in a radial direction thereof is located on a front side of a center 54*x* of the opening part 54*e* of the front side R part 54 in a radial direction thereof by a predetermined distance y (see FIG. 3). Additionally, such a predetermined distance y is settable at any value.

Thereby, waste in the water drainage socket 5 is prevented from being retained therein and a siphon action is caused in the water drainage socket 5 sustainably, so that it is possible to further improve a discharge performance for waste in the flush toilet 1.

That is, for example, waste that passes through the front side R part 54 readily flows into a front side in a vicinity of the downstream side end part 54*b* by a water strength of washing water and/or the like. The throttle part 56 according to the present embodiment is configured in such a manner that a center 56*x* of a flow channel thereof is located on a front side of a center 54*x* of a flow channel of the front side R part 54, so that it is possible to discharge, for example, waste that flows into a front side of a vicinity of the downstream side end part 54*b*, from a flow channel of the throttle part 56 (in detail, the opening part 56*b*) smoothly, in other words, it is possible to prevent waste in the water drainage socket 5 from being retained therein.

Furthermore, for example, at a time of toilet washing, it is possible to change a flow direction of washing water that flows through the front side R part 54 to a front side (in other words, washing water that flows through the throttle part 56 has a vector that is directed to a front side in frontward and backward directions) by the throttle part 56 as described above, so that a vicinity of the front side R part 54 and the throttle part 56 is readily filled with washing water. Hence, in the present embodiment, it is possible to cause a siphon action in the water drainage socket 5 sustainably without causing a break thereof to a downstream side of the water drainage socket 5, that is, the throttle part 56, so that it is possible to further improve a discharge performance for waste in the flush toilet 1.

The opening part 56*b* of the throttle part 56 includes a sloping surface 56*e* as illustrated in FIGS. 3 and 5. The sloping surface 56*e* is formed on an inner peripheral surface 56*b*1 of the opening part 56*b*. In detail, the sloping surface 56*e* is formed over a whole circumference of an end edge on an upstream side (an upper end edge) for the inner peripheral surface 56*b*1 of the opening part 56*b*. Additionally, although the sloping surface 56*e* is formed over a whole circumference of an end edge for the inner peripheral surface 56*b*1 of the opening part 56*b* in the above, this is not limiting where it may be formed on, for example, a part of such an end edge.

Furthermore, the sloping surface 56*e* is formed so as to slope downward toward a downstream side (that is, a side of a negative direction of a Z-axis). Thereby, for example, washing water and/or waste that pass(es) through the opening part 56*b* of the throttle part 56 readily flows toward a downstream side along the sloping surface 56*e*, and hence, it is possible to further prevent waste in the water drainage socket 5 from being retained therein.

An explanation for the throttle part 56 will be continued. A side wall part 56*c* of the throttle part 56 is provided so as to stand upward from an outer peripheral edge of the bottom surface part 56*a* as illustrated in FIGS. 3 and 5 and/or the like. A groove part 54*f* (see FIG. 3) that is capable of inserting the side wall part 56*c* thereinto is formed on the front side R part 54 at a position that corresponds to the side wall part 56*c*. Then, when the throttle part 56 is attached to the front side R part 54, the side wall part 56*c* of the throttle part 56 is inserted into the groove part 54*f* of the front side R part 54. Thereby, the throttle part 56 is positioned on and attached to the front side R part 54.

The engagement part 56*d* is a site that engages with the front side R part 54. For example, a plurality of (for example, three) engagement parts 56*d* are formed on the side wall part 56*c*. Additionally, a number of an engagement part(s) 56*d* as described above is not limitative but is merely illustrative. Furthermore, for the engagement part 56*d*, although it is possible to use, for example, a snap-fit one that has an engagement claw 56*d*1 and/or the like, this is not limiting.

Furthermore, an engagement hole 54*g* that functions as an engagement target part is formed on the front side R part 54 at a position that corresponds to the engagement part 56*d* (see FIGS. 3, 4, and 6). Then, when the throttle part 56 is attached to the front side R part 54, the engagement claw 56*d*1 of the engagement part 56*d* engages with the engagement hole 54*g* (for example, it is deformed elastically and caught thereon), so that the throttle part 56 is fixed on the front side R part 54.

Additionally, although the throttle part 56 is fixed on the front side R part 54 by using the engagement part 56*d* and/or the like in the above, this is not limiting. That is, the throttle part 56 may be fixed on the front side R part 54 by using, for example, an adhesive material and/or the like, in addition to or instead of the engagement part 56*d* and/or the like.

Furthermore, although an example where the throttle part 56 and the front side R part 54 are separate bodies is illustrated in the above, this is not limiting where, for example, the throttle part 56 and the front side R part 54 may be formed integrally.

As has been described above, a flush toilet 1 according to an embodiment includes a bowl part 2, a water spout part 3, a drainage water trap part 4, and a water drainage socket 5. The bowl part 2 has a waste-receiving surface 21 with a bowl shape and a rim part 22 that is formed on an upper side of the waste-receiving surface 21. The water spout part 3 is provided on the rim part 22 and spouts washing water toward an inside of the bowl part 2. The drainage water trap part 4 is connected to a bottom part 2*a* of the bowl part 2 and discharges waste in the bowl part 2. The water drainage socket 5 is provided with an upstream side that is connected to the drainage water trap part 4 and a downstream side that is connected to a water drainage port 62 of a floor surface F. The water drainage socket 5 has a back side R part 52 that changes a flow channel in such a manner that washing water that flows from an upper side is directed to a front side, a front side R part 54 that is provided on a downstream side of the back side R part 52 and changes a flow channel in such a manner that washing water that flows from a back side is directed to a lower side, and a water storage part 55 that stores a part of washing water on a flow channel from the back side R part 52 to the front side R part 54.

Furthermore, the water drainage socket 5 includes a throttle part 56 that is provided on a downstream side of the front side R part 54 and decreases a cross-sectional area of a flow channel of the front side R part 54. Thereby, in the present embodiment, it is possible to improve a discharge performance for waste.

First Variation

Figure 7:
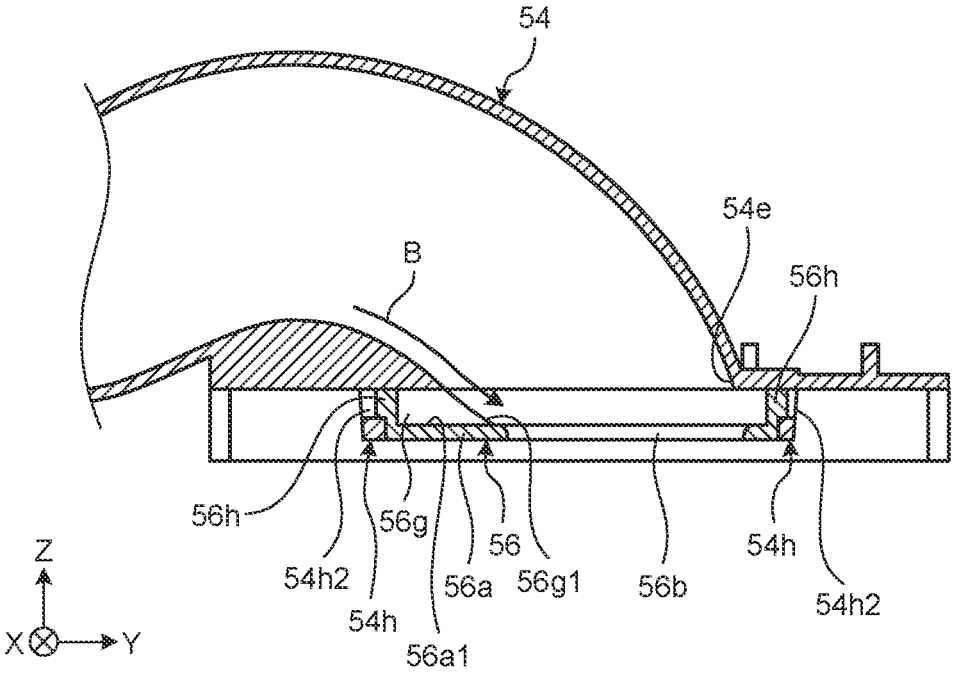
FIG. 7 is an enlarged cross-sectional view of a vicinity of a throttle part according to a first variation.
Figure 8:
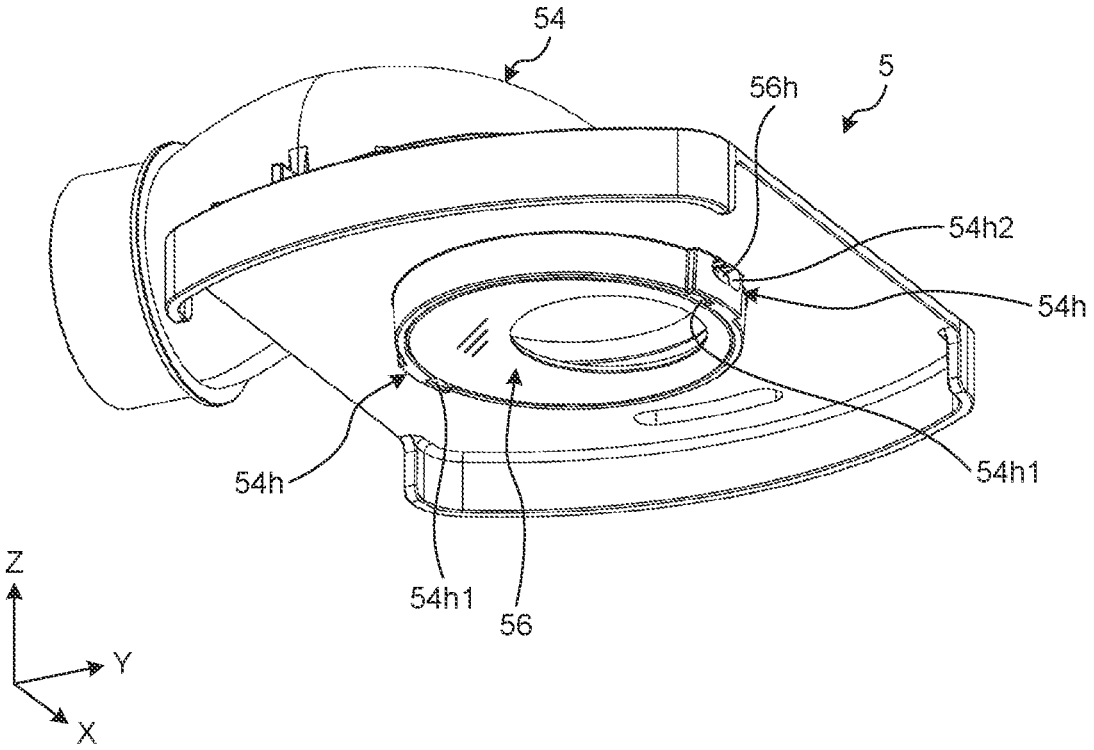
FIG. 8 is a perspective view when a throttle part according to a first variation and a front side R part are viewed from a lower side.
Figure 9:
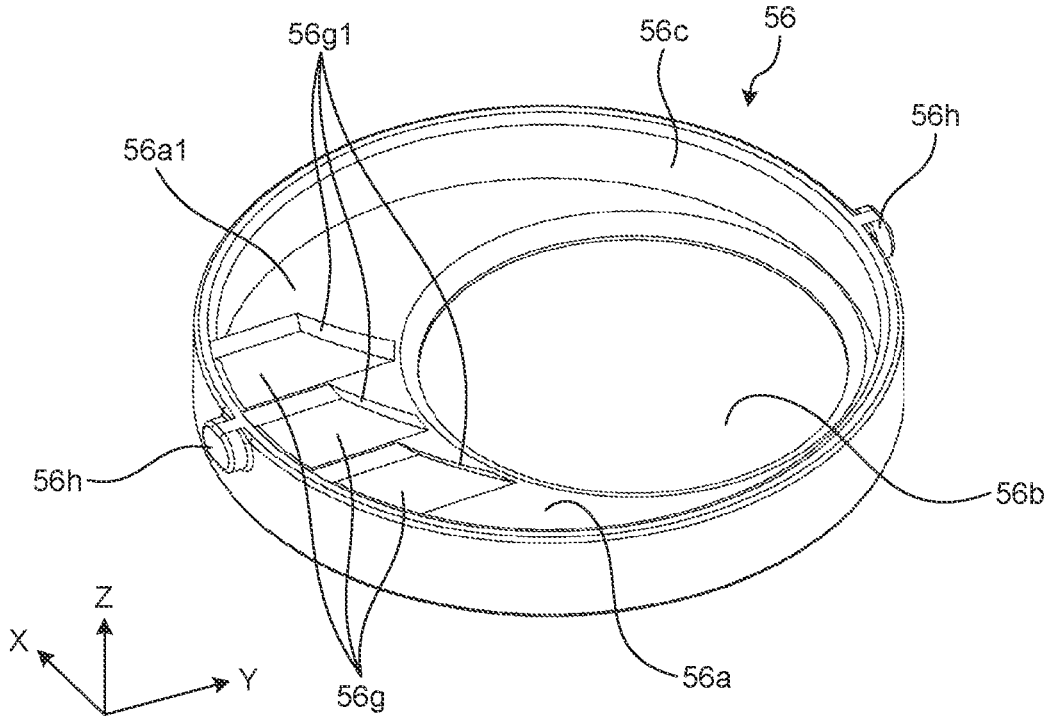
FIG. 9 is a perspective view of a throttle part according to a first variation.

Next, a first variation will be explained with reference to FIG. 7 to FIG. 9. FIG. 7 is an enlarged cross-sectional view of a vicinity of a throttle part 56 according to a first variation. FIG. 8 is a perspective view when a throttle part 56 according to a first variation and a front side R part 54 are viewed from below. FIG. 9 is a perspective view of a throttle part 56 according to a first variation. Additionally, a component that is common to that of an embodiment(s) as described above will be provided with an identical sign so as to omit an explanation thereof below.

As illustrated in FIG. 7 to FIG. 9, the throttle part 56 according to a first variation includes a rib 56*g* (that is not illustrated in FIG. 8) and a protrusion for engagement 56*h*.

The rib 56*g* is a site that guides waste to a downstream side as illustrated in FIGS. 7 and 9. For example, the rib 56*g* is provided so as to stand upward from an upper surface 56*a*1 of a bottom surface part 56*a*. Furthermore, a plurality of (for example, three) ribs 56*g* are formed on the bottom surface part 56*a* at such a position as to plug a back side of an opening part 54*e* of a front side R part 54. Furthermore, the plurality of ribs 56*g* are formed so as to separate from one another at a predetermined interval(s) in leftward and rightward directions (directions of an X-axis) as illustrated in FIG. 9. Additionally, a number (three) of the plurality of ribs 56*g* as described above is not limited but is merely illustrative where, for example, two or four or more thereof may be provided. Furthermore, a number of a rib(s) 56*g* may be one.

Furthermore, a sloping surface 56*g*1 is formed on each of the plurality of ribs 56*g*. Furthermore, the sloping surface 56*g*1 is formed on a site of a rib 56*g* on a side of an opening part 56*b*. Furthermore, the sloping surface 56*g*1 is formed so as to slope downward toward a downstream side (that is, a side of a negative direction of a Z-axis).

In a first variation, the throttle part 56 includes the rib 56*g* as described above, so that, for example, at a time of toilet washing, waste that reaches a vicinity of the throttle part 56 is guided by the rib 56*g* so as to readily flow toward a downstream side (see an arrow B in FIG. 7). In detail, waste that reaches a vicinity of the throttle part 56 readily flows toward a downstream side along the sloping surface 56*g*1 of the rib 56*g*. Therefore, in a first variation, it is possible to further prevent waste from being retained in a water drainage socket 5.

Furthermore, the plurality of ribs 56*g* are formed on the bottom surface part 56*a* so as to separate from one another, so that a part of washing water that reaches a vicinity of the throttle part 56 passes between the plurality of ribs 56*g* and strikes the bottom surface part 56*a*. Hence, in a first variation, even in a case where the rib 56*g* is included therein, it is possible to change a flow direction of washing water that flows through the front side R part 54 to, for example, a front side, similarly to an embodiment, so that a vicinity of the front side R part 54 and the throttle part 56 is readily filled with washing water. Therefore, also in a first variation, it is possible to cause a siphon action in the water drainage socket 5 sustainably without causing a break thereof to a downstream side of the water drainage socket 5, that is, the throttle part 56, so that it is possible to further improve a discharge performance for waste in a flush toilet 1.

The protrusion for engagement 56*h* is a site that engages with the front side R part 54. For example, a plurality of (for example, two) protrusions for engagement 56*h* are formed so as to protrude laterally from a side wall part 56*c*. Additionally, a number of a protrusion(s) for engagement 56*h* as describe above is not limited but is merely illustrative.

Furthermore, an engagement target part 54*h* is formed on the front side R part 54 at a position that corresponds to the protrusion for engagement 56*h* (see FIGS. 7 and 8). The engagement target part 54*h* includes an insertion hole 54*h*1 and an engagement hole 54*h*2. The insertion hole 54*h*1 is opened downward and the protrusion for engagement 56*h* is first inserted thereinto at a time of attachment of the throttle part 56 thereto. The engagement hole 54*h*2 is communicated with the insertion hole 54*h*1 and is configured to be capable of engaging with the protrusion for engagement 56*h* that is inserted into the insertion hole 54*h*1.

Therefore, when the throttle part 56 is attached to the front side R part 54, the protrusion for engagement 56*h* is inserted into the insertion hole 54*h*1 and subsequently the throttle part 56 is rotated around a vertical direction as a center in such a manner that the protrusion for engagement 56*h* engages with (is caught on) the engagement hole 54*h*2, so that the throttle part 56 is fixed on the front side R part 54.

Second Variation

Figure 10:
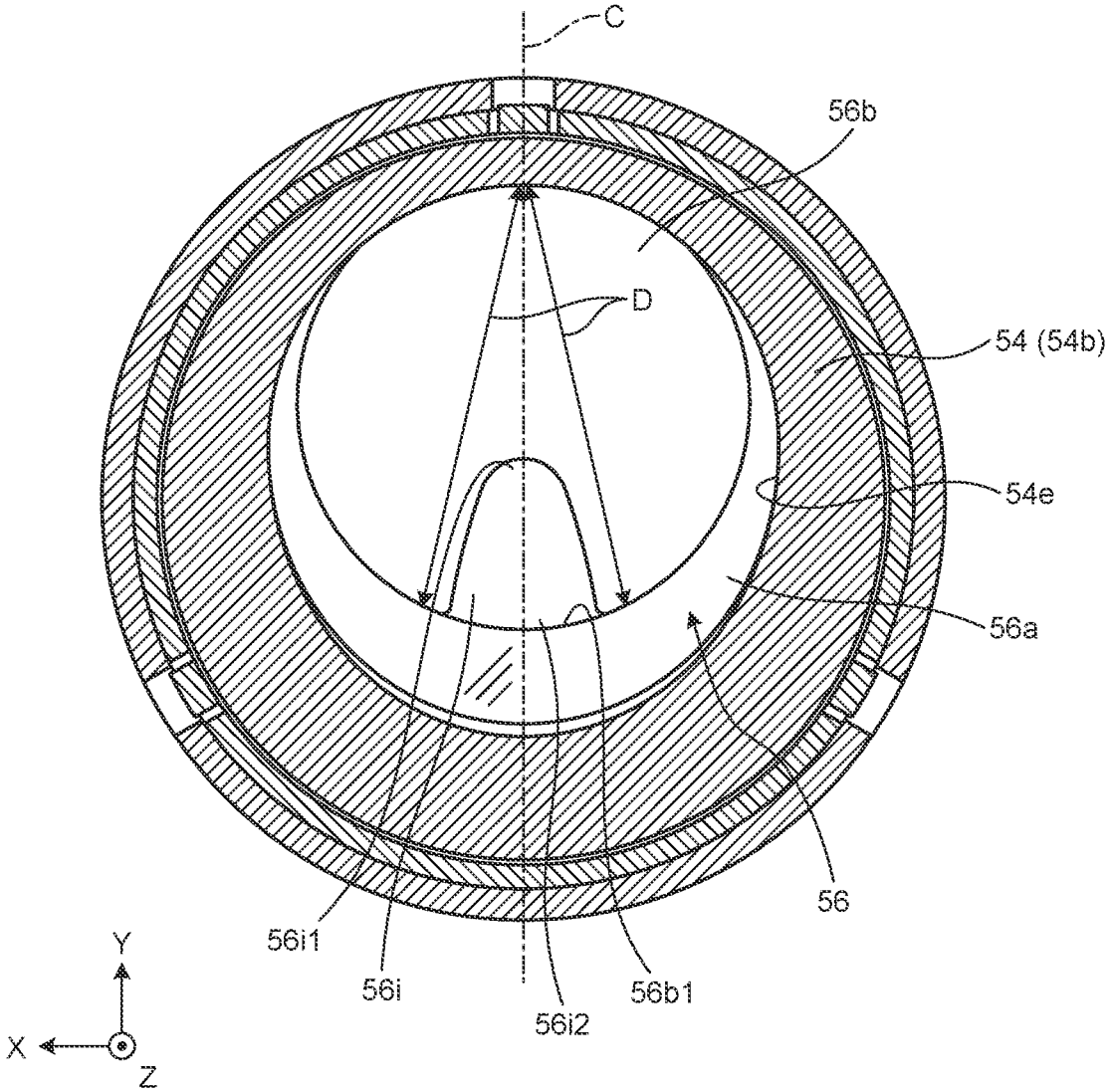
FIG. 10 is a transverse cross-sectional view of a front side R part where a throttle part according to a second variation is attached thereto.

Next, a second variation will be explained with reference to FIG. 10. FIG. 10 is a transverse cross-sectional view of a front side R part 54 where a throttle part 56 according to a second variation that is attached thereto, and is also a cross-sectional view that is similar to FIG. 3.

As illustrated in FIG. 10, the throttle part 56 according to a second variation is configured to cover an opening part 54*e* of the front side R part 54 more widely, as compared with an embodiment. Specifically, the throttle part 56 according to a second variation includes a protrusion part 56*i*.

The protrusion part 56*i* is formed so as to protrude from an inner peripheral surface 56*b*1 of an opening part 56*b* toward a side of a flow channel of the opening part 56*b*. For example, the protrusion part 56*i* is formed so as to extend from the inner peripheral surface 56*b*1 of the opening part 56*b* along a center line C of the opening part 56*b*.

Thus, in a second variation, the throttle part 56 includes the protrusion part 56*i* as described above, so that, for example, at a time of toilet washing, a part of washing water that reaches a vicinity of the throttle part 56 also strikes the protrusion part 56*i* in addition to a bottom surface part 56*a*. Thereby, it is possible to change a flow direction of a comparatively high amount of washing water to, for example, a front side, so that a vicinity of the front side R part 54 and the throttle part 56 is filled with washing water more readily. Therefore, in a second variation, it is possible to cause a siphon action in a water drainage socket 5 sustainably without causing a break thereof to a downstream side of the water drainage socket 5, that is, the throttle part 56 reliably, and hence, it is possible to further improve a discharge performance for waste in a flush toilet 1.

Furthermore, the protrusion part 56*i* is formed in such a manner that a width thereof in leftward and rightward directions (directions of an X-axis) is decreased toward a distal end 56*i*1 thereof. In other words, the protrusion part 56*i* is formed into a taper shape where a width thereof in leftward and rightward directions is deceased from a proximal end 56*i*2 thereof toward the distal end 56*i*1, in a transverse cross-sectional view (a top view).

Thereby, even in a case where the throttle part 56 according to a second variation includes the protrusion part 56*i*, it is possible to prevent waste from being retained in the water drainage socket 5. That is, the protrusion part 56*i* according to a second variation is formed in such a manner that a width thereof is decreased toward the distal end 56*i*1, so that it is possible to increase a maximum opening width D of the opening part 56*b* of the throttle part 56 as much as possible. Thus, a maximum opening width D of the opening part 56*b* is increased, so that it is possible for waste to pass through the opening part 56*b* (that is, a flow channel of the throttle part 56) even in a case where the throttle part 56 includes the protrusion part 56*i*, and hence, it is possible to prevent waste from being retained in the water drainage socket 5.

Third Variation

Figure 11:
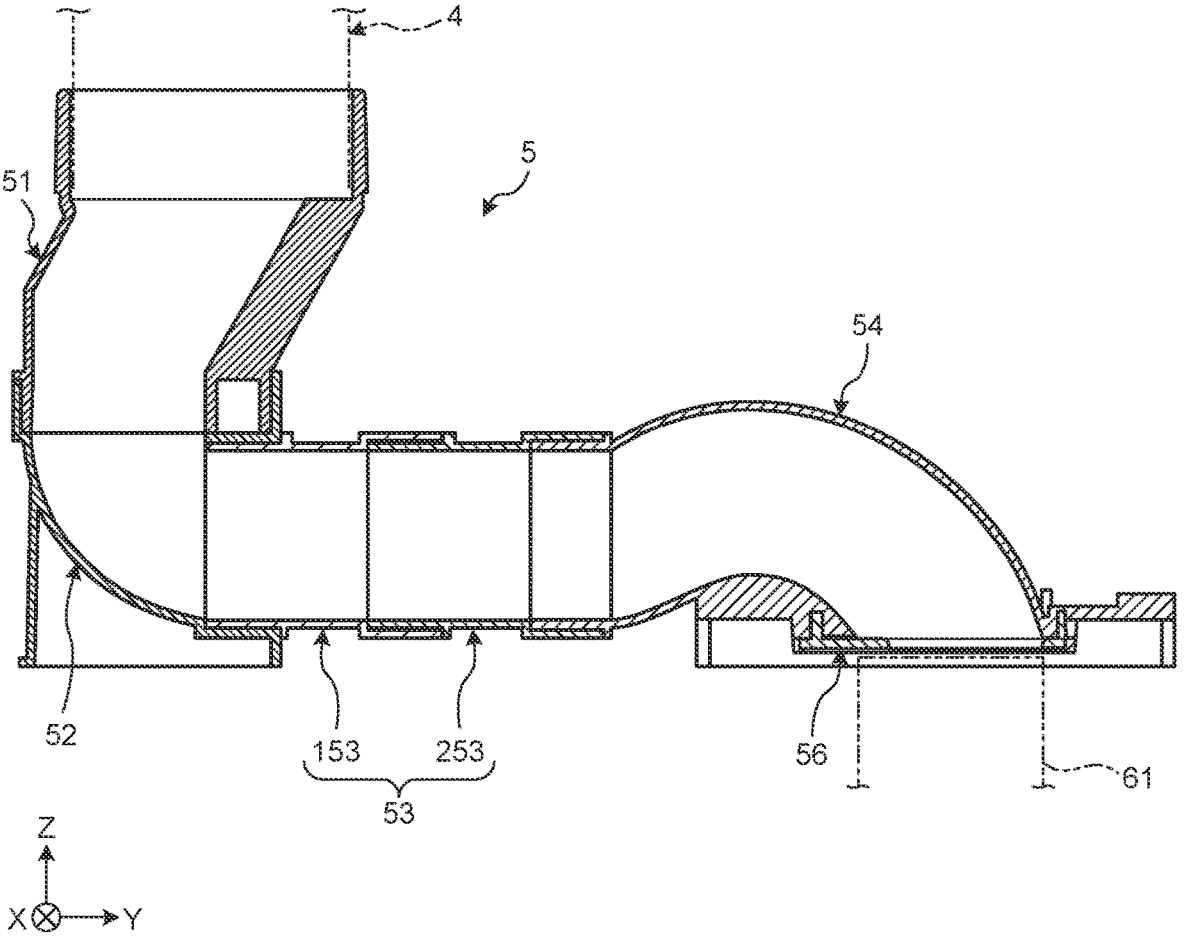
FIG. 11 is an enlarged cross-sectional view of a water drainage socket according to a third variation.

Next, a third variation will be explained with reference to FIG. 11. FIG. 11 is an enlarged cross-sectional view of a water drainage socket 5 according to a third variation. As illustrated in FIG. 11, a plurality of horizontal pipes 53 are joined in the water drainage socket 5 according to a third variation. In an example of FIG. 11, a horizontal pipe 53 includes a first horizontal pipe 153 and a second horizontal pipe 253 that is joined to the first horizontal pipe 153.

Thus, in a third variation, the plurality of horizontal pipes 53 (herein, the first and second horizontal pipes 153, 253) are joined, so that it is possible to adjust a length of the water drainage socket 5 in frontward and backward directions (directions of a Y-axis), depending on, for example, a position of a water drainage piping 61 and/or the like.

Additionally, although FIG. 11 illustrates an example where two horizontal pipes 53 are joined, this is not limiting where, for example, three or more horizontal pipes 53 may be joined.

An aspect of an embodiment aims to provide a flush toilet that is capable of improving a discharge performance for waste.

A flush toilet according to an aspect of an embodiment includes a bowl part that has a waste-receiving surface with a bowl shape and a rim part that is formed on an upper side of the waste-receiving surface, a water spout part that is provided on the rim part and spouts washing water toward an inside of the bowl part, a drainage water trap part that is connected to a bottom part of the bowl part and discharges waste in the bowl part, and a water drainage socket that is provided with an upstream side that is connected to the drainage water trap part and a downstream side that is connected to a water drainage port of a floor surface where the water drainage socket has a back side R part that changes a flow channel in such a manner that washing water that flows from an upper side is directed to a front side, a front side R part that is provided on a downstream side of the back side R part and changes a flow channel in such a manner that washing water that flows from a back side is directed to a lower side, and a water storage part that stores a part of washing water on a flow channel from the back side R part to the front side R part, wherein the water drainage socket includes a throttle part that is provided on a downstream side of the front side R part and decreases a cross-sectional area of a flow channel of the front side R part.

Thereby, it is possible to improve a discharge performance for waste in a flush toilet. That is, a throttle part is provided on a downstream side of a front side R part, so that, for example, at a time of toilet washing, a flow direction of washing water that flows through such a front side R part is changed, and as a result, a vicinity of such a front side R part and such a throttle part is readily filled with washing water. Hence, for example, washing water that is stored in a water storage part is utilized, so that it is possible to cause a siphon action that is caused at such a water storage part and on an upstream side of such a water storage part, in a water drainage socket sustainably, without causing a break thereof to a downstream side of such a water drainage socket, that is, a throttle part. Such a siphon action is caused, so that it is possible to discharge waste, together with washing water, from a water discharge port reliably, and hence, it is possible to improve a discharge performance for waste in a flush toilet.

Furthermore, the throttle part is provided at a position that is lower than that of a lower end part of the water storage part.

Thereby, for example, it is possible to increase a flow velocity (in other words, a water strength) of washing water that flows from a water storage part to a throttle part through a front side R part at a time when falling onto such a throttle part. Then, a flow direction of washing water with an increased flow velocity is changed by a throttle part, so that a vicinity of a front side R part and such a throttle part is filled with washing water more readily, and hence, it is possible to cause a siphon action reliably.

Furthermore, a center of a flow channel of the throttle part in a radial direction thereof is located on a front side of a center of a flow channel of a site where the throttle part is provided in the front side R part in a radial direction thereof.

Thereby, waste is prevented from being retained in a water drainage socket and a siphon action is caused in such a water drainage socket sustainably, so that it is possible to further improve a discharge performance for waste in a flush toilet.

That is, for example, waste that passes through a front side R part readily flows into a front side in a vicinity of a downstream side end part thereof, by a water strength of washing water and/or the like. A throttle part is configured in such a manner that a center of a flow channel thereof is located on a front side of a center of a flow channel of a front side R part, so that it is possible to discharge, for example, waste that flows into a front side of a vicinity of a downstream side end part thereof, from a flow channel of such a throttle part smoothly, in other words, it is possible to prevent waste from being retained in a water drainage socket.

Furthermore, for example, at a time of toilet washing, it is possible to change a flow direction of washing water that flows through a front side R part to a front side (in other words, washing water that flows through a throttle part has a vector toward a frontward direction in frontward and backward directions) by a throttle part as described above, so that a vicinity of such a front side R part and such a throttle part is readily filled with washing water. Hence, it is possible to cause a siphon action in a water drainage socket sustainably, without causing a break thereof to a downstream side of such a water drainage socket, that is, a throttle part, so that it is possible to further improve a discharge performance for waste in a flush toilet.

Furthermore, the throttle part includes an opening part that forms a flow channel, and the opening part includes a sloping surface that is formed on an inner peripheral surface thereof and slopes downward toward a downstream side.

Thereby, for example, at a time of toilet washing, washing water and/or waste that pass(es) through an opening part of a throttle part readily flow(s) to a downstream side along a sloping surface, and hence, it is possible to further prevent waste from being retained in a water drainage socket.

Furthermore, the throttle part includes a rib that guides waste to a downstream side.

Thereby, for example, at a time of toilet washing, waste that reaches a vicinity of a throttle part is guided by a rib so as to readily flow toward a downstream side. Hence, it is possible to further prevent waste from being retained in a water drainage socket.

Furthermore, the throttle part includes an opening part that forms a flow channel, and a protrusion part that protrudes from an inner peripheral surface of the opening part toward a side of a flow channel of the opening part.

Thereby, for example, at a time of toilet washing, a part of washing water that reaches a vicinity of a throttle part also strikes a protrusion part. Therefore, it is possible to change a flow direction of a comparatively high amount of washing water at a throttle part, so that a vicinity of a front side R part and such a throttle part is filled with washing water more readily. Hence, it is possible to cause a siphon action in a water drainage socket sustainably, without causing a break thereof to a downstream side of such a water drainage socket, that is, a throttle part reliably, and hence, it is possible to further improve a discharge performance for waste in a flush toilet.

According to an aspect of an embodiment, it is possible to improve a discharge performance for waste.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet, comprising:

a bowl part that includes a waste-receiving surface with a bowl shape and a rim part that is formed on an upper side of the waste-receiving surface;

a water spout part that is provided on the rim part and spouts washing water toward an inside of the bowl part;

a drainage water trap part that is connected to a bottom part of the bowl part and discharges waste in the bowl part; and a water drainage socket that is provided with an upstream side that is connected to the drainage water trap part and a downstream side that is connected to a water drainage port of a floor surface where the water drainage socket includes a back side R part that changes a flow channel in such a manner that washing water that flows from an upper side is directed to a front side, a front side R part that is provided on a downstream side of the back side R part and changes a flow channel in such a manner that washing water that flows from a back side is directed to a lower side, and a water storage part that stores a part of washing water on a flow channel from the back side R part to the front side R part, wherein the water drainage socket includes a throttle part that is provided on a downstream side of the front side R part and decreases a cross-sectional area of a flow channel of the front side R part, wherein a center of a flow channel of the throttle part in a radial direction thereof is located on a front side of a center of a flow channel of a site where the throttle part is provided in the front side R part in a radial direction thereof.

2. The flush toilet according to claim 1, wherein the throttle part is provided at a position that is lower than that of a lower end part of the water storage part.

3. The flush toilet according to claim 1, wherein:

the throttle part includes an opening part that forms a flow channel; and the opening part includes a sloping surface that is formed on an inner peripheral surface thereof and slopes downward toward a downstream side.

4. The flush toilet according to claim 1, wherein the throttle part includes a rib that guides waste to a downstream side.

5. The flush toilet according to claim 1, wherein the throttle part includes:

an opening part that forms a flow channel; and a protrusion part that protrudes from an inner peripheral surface of the opening part toward a side of a flow channel of the opening part.

* * * * *